US008475078B2

(12) United States Patent
Denning

(10) Patent No.: US 8,475,078 B2
(45) Date of Patent: Jul. 2, 2013

(54) CONTAINMENT DEVICE, METHOD AND SYSTEM

(76) Inventor: Thomas Alan Denning, Hays, KS (US)

( * ) Notice: Subject to any disclaimer, the term of this patent is extended or adjusted under 35 U.S.C. 154(b) by 678 days.

(21) Appl. No.: 12/614,996

(22) Filed: Nov. 9, 2009

(65) Prior Publication Data

US 2010/0126623 A1 May 27, 2010

Related U.S. Application Data

(60) Provisional application No. 61/117,093, filed on Nov. 22, 2008.

(51) Int. Cl.
*B65D 90/24* (2006.01)

(52) U.S. Cl.
USPC ..... 405/52; 405/43; 405/45; 405/129.45; 405/129.55; 137/312; 141/86

(58) Field of Classification Search
USPC ..... 141/1, 86, 234; 405/43, 45, 50, 49, 405/154.1, 47, 51, 52, 116, 129.55; 285/130.1, 285/129.1, 129.2, 189; 138/177, 178
See application file for complete search history.

(56) References Cited

U.S. PATENT DOCUMENTS

| | | | | |
|---|---|---|---|---|
| 12,688 | A | 4/1855 | Manahan | |
| 740,413 | A | 10/1908 | Fruin | |
| 3,647,194 | A * | 3/1972 | Brungraber et al. | 432/234 |
| 3,699,684 | A * | 10/1972 | Sixt | 405/49 |
| 3,787,078 | A * | 1/1974 | Williams | 285/189 |
| 4,068,478 | A * | 1/1978 | Meyers et al. | 405/66 |
| 4,118,816 | A * | 10/1978 | Mittag | 14/69.5 |
| 4,842,443 | A * | 6/1989 | Argandona | 405/52 |
| 5,129,757 | A * | 7/1992 | Johnson | 405/43 |
| 5,281,052 | A * | 1/1994 | Beamer | 405/119 |
| 5,454,195 | A * | 10/1995 | Hallsten | 52/169.1 |
| 5,544,974 | A * | 8/1996 | Berg et al. | 405/53 |
| 5,586,416 | A * | 12/1996 | Hess et al. | 52/169.5 |
| 5,785,454 | A * | 7/1998 | Ringdal et al. | 405/45 |
| 5,800,091 | A * | 9/1998 | Van Romer | 405/52 |
| 6,612,780 | B2 * | 9/2003 | Dahowski et al. | 405/118 |
| 6,783,300 | B2 * | 8/2004 | Doolaege | 405/115 |
| 6,821,424 | B1 * | 11/2004 | Branz | 210/605 |
| 2002/0172557 | A1 * | 11/2002 | Chen | 405/43 |
| 2009/0324335 | A1 * | 12/2009 | Fossen et al. | 405/116 |

* cited by examiner

*Primary Examiner* — Timothy L Maust
*Assistant Examiner* — Robert Bell, III
(74) *Attorney, Agent, or Firm* — Kilpatrick Townsend & Stockton LLP

(57) ABSTRACT

Embodiments disclosed herein relate to systems, methods and devices for containing a substance within a region. In some embodiments, one or more hollow structures are positioned around the region and the structures are at least partly filled (e.g., through fill openings) with a weighting material. Some embodiments relate to a curved device comprising steps, such that a first cross-section of the device comprises a round shape and a second cross-section comprises a plurality of substantially linear segments. Some embodiments relate to a tank connection device comprising a sleeve extending through a curved device.

34 Claims, 8 Drawing Sheets

CONTAINMENT DEVICE, METHOD AND SYSTEM

CROSS-REFERENCE TO RELATED APPLICATIONS

This application claims the benefit of priority to U.S. Provisional Patent Application No. 61/117,093, filed on Nov. 22, 2008, which is hereby incorporated by reference in its entirety.

BACKGROUND OF THE INVENTION

Many facilities require a containment device for various tanks and vessels to prevent fluids and other mediums from accidentally spreading due to leaks, ruptures, manmade mistakes and other reasons. Two such containment devices commonly used are earthen dikes and berms. Containment devices such as these may suffer from erosion due to, for example, wind, rain, animals and/or foot traffic. Additionally, animals burrowing in the devices may also reduce the devices' structural stability. The containment devices may be covered over with rock, asphalt millings and other materials to help maintain their structural stability, but frequently, containment structures must be continually rebuilt. Often times these facilities are remotely located (for example-oil field tanks), and it is difficult and/or expensive to maintain the devices.

Other containment devices, such as concrete walls and galvanized metal, are sometimes used. However, concrete walls are expensive, can crack and are hard to dispose of when abandoning the site. Galvanized metal walls frequently cannot withstand moderate to strong winds, and the metal corrodes when exposed to corrosive materials such as salt water and corrosive gases, both of which tend to be present in oil field operations.

SUMMARY OF THE INVENTION

In some embodiments, a containment system for containing a substance is provided, the system comprising a plurality of fillable devices, each device comprising: a first at least partly open end; a second at least partly open end; a cavity between the first and second open ends; and at least one opening on a surface between the first and second ends, wherein the fillable devices are arranged such that the first end of at least one of the devices is adjacent to the second end of another of the devices. The fillable devices may be arranged in a closed shape, such that the first end of each of the plurality of fillable devices is adjacent to the second end of an adjacent fillable device. The plurality of fillable devices may be positioned such that at least one opening is on the top of the devices. Each device may comprise a plurality of openings. The openings may be, for example, between about 2 inches and about 6 inches in diameter. The openings may be substantially evenly spaced across a length of each device. The openings may be separated by a distance between about 2 feet and 8 feet. The devices may comprise a substantially circular cross section. A diameter of the devices may be, for example, between about 1 foot and about 4 feet or, for example, about 2 feet. The containment system may further include one or more covers configured to cover one or more of the openings. Each of the covers may be configured to cover one of the openings and/or a plurality of openings. The device may further comprise a hinge connecting one of the covers to one or more of the devices, such that the cover can rotate to cover one or more of the openings. The fillable devices may comprise high-density polyethylene or metal. At least one of the fillable devices may comprise a substantially cylindrical shape. The first end of at least one of the devices may be facing a direction that is substantially non-parallel to a direction faced by the second end of the at least one device. The first end of at least one of the devices may be facing a direction that is about 90 degrees offset from a direction faced by the second end of the at least one device. At least one of the devices may comprise steps. A surface connecting the first and second ends of at least one of the devices may include a curved surface and plurality of substantially flat surfaces. The plurality of substantially flat surfaces may be offset from each other in a vertical direction. At least one of the devices may include a sleeve extending through the at least one device in a first direction, the first direction being non-parallel to a side of the device connecting the first and second ends. At least one device may include a drip catching structure below the sleeve. The drip catching structure may include at least one of a well or basin. The substance may include a liquid and/or oil. In some embodiments, the substance is hazardous; in some embodiments, the substance is non-hazardous. The containment system may form a continuous, uninterrupted enclosure.

In some embodiments, a method of making a containment structure is provided, the method comprising: identifying a containment region; positioning a plurality of fillable devices around at least part of the perimeter of the region; and optionally at least partly filling the plurality of fillable devices with a weighting substance, wherein each of the plurality of fillable devices comprises: a first at least partly open end; a second at least partly open end; a cavity between the first and second open ends; and at least one opening on a surface between the first and second ends. In some embodiments, the optional step is included and is not optional. The method may further include leveling the identified region and/or evacuating earth materials from at least a portion of a perimeter of the containment region. The earth materials may comprise one or more of dirt, sand rock and grass. The evacuating may include evacuating earth materials along the perimeter to a depth between about 2 inches and about 6 inches and/or forming a rounded shape in the ground. The containment region may include a fluid storage unit. The method may further include positioning the devices to be adjacent to each other. The method may further include positioning a sealing material around the perimeter of the region. The plurality of fillable devices may be positioned over the sealing material. The sealing material may be positioned adjacent to the fillable devices. In some embodiments, the sealing material may include at least one of dirt, clay, bentonite, rubber, and asphalt (e.g., asphalt chips). In some embodiments, the weighting substance may include a solid material and/or at least one of sand, soil, rocks, dirt, gravel, asphalt (e.g., asphalt chips) and rubber. The method may further include covering said openings with a cover. The positioning may include arranging the devices such that the first end of each of the plurality of fillable devices is adjacent to the second end of an adjacent fillable device. The plurality of fillable devices may be positioned such that the at least one opening is on the top of the devices. Each device may include a plurality of openings. The devices may include a substantially circular cross section. A diameter of the devices may be between about 1 foot and about 4 feet. Each device may include one or more covers configured to cover one or more of the at least one openings. One or more of the fillable devices may include, for example, high density polyethylene or metal. At least one of the fillable devices may comprise a substantially cylindrical shape. The first end of at least one of the devices may be facing a direction that is substantially non-parallel to a direction faced by the second end of the at least one device. The first end of at least one of the devices may be facing a direction that is about 90 degrees offset from a direction faced by the second end of the at least one device. At least one of the devices may comprise steps. A surface connecting the first and second ends of at least one of the devices may comprise a curved surface and plurality of substantially flat surfaces. At least one of the devices may include a sleeve extending through the at least one device in a first direction, the first direction being non-parallel to a side of the device connecting the first and second ends. The at least one device may comprise a drip catching structure below the sleeve. The drip catching structure may comprise at least one of a well or basin.

In some embodiments, a fillable device is provided, the fillable device comprising: a first at least partly open end; a second at least partly open end; a cavity between the first and second open ends; at least one opening on a surface between the first and second ends; and a side connecting the first and second ends that is curved such that the first end is facing a direction that is substantially non-parallel to a direction faced by the second end. The at least one opening may include a plurality of openings. The openings may be between about 2 inches and about 6 inches in diameter. The first and second at least partly open ends may comprise a length along a dimension of at least about 12 inches. The openings may be substantially evenly spaced across a length of the device. The device may include a substantially circular cross section. A diameter of the device may be between about 1 foot and about 4 feet. A diameter of the device may be about 2 feet. The device may further include one or more covers configured to cover one or more of the at least one openings. The device may include, for example, high density polyethylene and/or metal. The first end may be facing a direction that is about 90 degrees offset from a direction faced by the second end.

In some embodiments, a fillable device is provided, the device comprising: a first at least partly open end; a second at least partly open end; a cavity between the first and second open ends; at least one opening on a surface between the first and second ends; and a side connecting the first and second ends, the side comprising a corner such that the first end is facing a direction that is substantially non-parallel to a direction faced by the second end. The at least one opening may include a plurality of openings. The openings may be between about 2 inches and about 6 inches in diameter and/or may be substantially evenly spaced across a length of the device. The device may include a substantially circular cross section. A diameter of the device may be between about 1 foot and about 4 feet and/or about 2 feet. The device may further include one or more covers configured to cover one or more of the openings. The device may include, for example, high density polyethylene and/or metal. The corner may be at a substantially 90 degree angle.

In some embodiments, a device is provided, the device comprising a first at least partly open end; a second at least partly open end; a cavity between the first and second open ends; a curved surface between the first and second ends; and a plurality of steps. The length of the device may be the distance between the first and second ends and the width the distance across the device in a direction perpendicular to the length. The steps may extend across the width of the device. The device may include a first round cross section and a second step cross section, the step cross section comprising a plurality of substantially linear segments. The device may further include a support structure configured to at least partly support a user using the steps. The support structure may include a hand rail. The surface may include at least one opening. The at least one opening may include a plurality of openings. The openings may be between about 2 inches and about 6 inches in diameter and/or may be substantially evenly spaced across a length of the device. The device may further include one or more covers configured to cover one or more of the at least one openings. The device may include a substantially circular cross section. A diameter of the device may be between about 1 foot and about 4 feet and/or about 2 feet. The device may comprise high density polyethylene.

In some embodiments, a step component is provided, the component comprising a curved supporting structure; and a plurality of steps rising above the curved supporting structure. A radius of the curved supporting structure may be between about 8 inches and about 30 inches. The component may comprise a first round cross section and a second step cross section, the step cross section comprising a plurality of substantially linear segments. The component may further include at least one opening on a surface of the component. The at least one opening may include a plurality of openings and/or may be between about 2 and about 6 inches in diameter. The openings may be substantially evenly spaced across a length of the device. The component may further include one or more covers configured to cover one or more of the at least one openings. The component may include, for example, high density polyethylene and/or metal.

In some embodiments, a method of modifying a round structure is provided, the method comprising positioning a step component described herein over the curved structure. The method may further include attaching the step component to the round structure. The round structure may include a shape substantially similar to a cylinder. The round structure may include a culvert.

In some embodiments, a method of modifying a round structure is provided, the method comprising removing a portion of the round structure thereby forming a void; and positioning a step component described herein over the void.

In some embodiments, a device is provided, the device comprising a first at least partly open end; a second at least partly open end; a cavity between the first and second open ends; and a sleeve extending through the at least one device in a first direction, the first direction being non-parallel to a side of the device connecting the first and second ends. The device may further include a drip catching structure below the sleeve, a drip catching cover configured to cover the drip catching structure, and/or at least one opening on a surface between the first and second ends. The drip catching structure may comprise at least one of a well or basin. The at least one opening may include a plurality of openings. The openings may be between about 2 inches and about 6 inches in diameter and/or substantially evenly spaced across a length of the device. The device may further include one or more covers configured to cover one or more of the at least one openings. The device may include a substantially circular cross section. The diameter of the device may be between about 1 foot and about 4 feet and/or may be about 2 feet. The device may include, for example, high density polyethylene and/or metal.

In some embodiments, a method of transporting a fluid is provided, the method comprising: attaching a fluid transportation unit to a fluid storage unit within a containment region; and inserting the fluid transportation unit into the sleeve of a device described herein. The method may further include opening a valve on or near the fluid storage unit and/or opening a valve within a device described herein. The fluid transportation unit may comprise a pipe.

In some embodiments, a tank connection component is provided, the component comprising: a supporting structure curved along a first direction; and a sleeve extending through the at least one component in the first direction. The component may further include a drip catching structure below the sleeve. The drip catching structure may comprise at least one of a well or basin. The component may further include a drip catching cover configured to cover the drip catching structure. A radius of the curved supporting structure may be between about 8 inches and about 30 inches. The component may further include at least one opening on a surface of the component. The at least one opening may include a plurality of openings. The openings may be between about 2 inches and about 6 inches in diameter and/or may be substantially evenly spaced across a length of the device. The component may further include one or more covers configured to cover one or more of at least one opening. The component may include, for example, high density polyethylene and/or metal.

In some embodiments, a method of modifying a round structure is provided, the method comprising: removing a portion of the round structure thereby forming a void; and positioning a tank connection component described herein over the curved structure. The method may further include attaching the tank connection component to the round structure. The round structure may include a shape substantially similar to a cylinder. The round structure may include a culvert.

In some embodiments, a method of transporting a fluid is provided, the method comprising: attaching a fluid transportation unit to a fluid storage unit within a containment region; and inserting the fluid transportation unit into the sleeve of a component described herein. The method may further include opening a valve on or near the fluid storage unit and/or opening a valve within a device described herein. The fluid transportation unit may include a pipe.

DETAILED DESCRIPTION OF THE PREFERRED EMBODIMENT

Embodiments provided herein relate to systems, methods and devices for containing or minimizing the spread of a medium or for containing a substance within a region. In some embodiments the systems may include a fillable device, such as a pipe, conduit (e.g., at least partially closed conduit) or duct. For example, in some embodiments, one or more structures or devices can be positioned around a region, and optionally, the structures/devices can be at least partly filled (e.g., through fill openings), such as with a weighting material. The device(s) may be positioned at least partly or completely around a location of a possible spill (e.g., around an oil tank battery). Some embodiments relate to a device that includes steps, such that a first cross-section of the device has or includes a round shape and a second cross-section includes or has a plurality of substantially linear segments. Some embodiments relate to a tank connection device that includes, for example, a sleeve extending through a curved device.

Some of the structures or devices may be fillable, for example. A fillable device may include, for example, a device with a cavity that can be at least partially filled with a substance, such as a weighting substance. In some instances, the device can include one or more openings or holes to allow access to the cavity. Thus, a substance may enter the openings or holes to fill the cavity. More details with regard to the openings or holes are described below.

Figure 1:
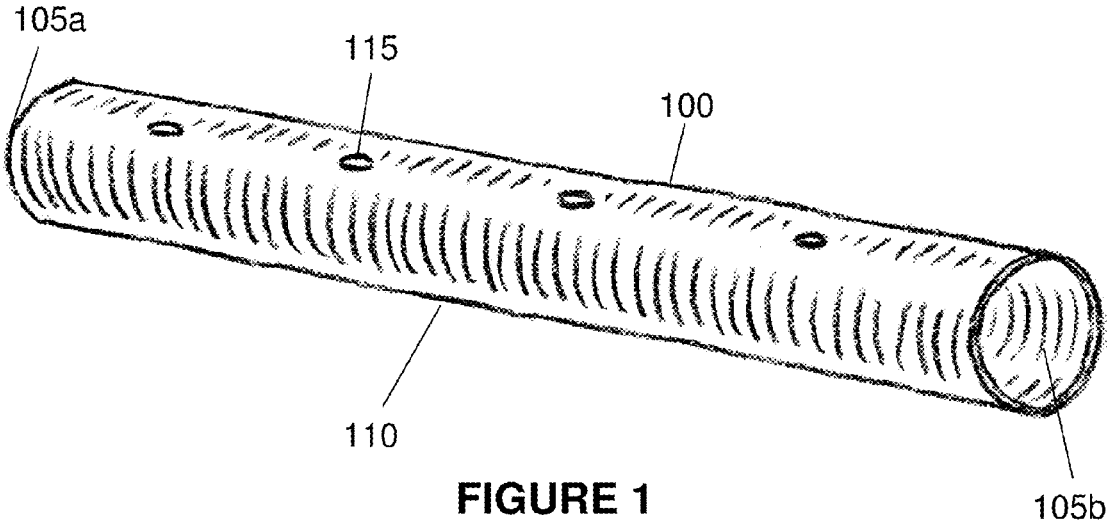
FIG. 1 shows an embodiment of a fillable device with a plurality of filling openings.

As shown in FIG. 1, the fillable device 100 may be or may include, for example, a pipe, conduit or duct. The pipe may include, for example, a culvert. The fillable device may include, for example, a first end 105*a* and a second end 105*b*. A dimension of the first end 105*a* and/or the second end 105*b* (e.g., a diameter) may be at least about, about or less than about 3, 6, 12, 18, 24, 36, 48 or 64 inches. The ends 105 may include, for example, large openings, allowing access to a cavity of the device 100. The first end 105*a* may be opposite from the second end 105*b*. In some instances, multiple fillable devices may be attached at their ends 105, which may thus form an extended cavity. In some embodiments, the device 100 can be positioned on its side 110, the side being, in this instance, a side between the two ends 105. The side 110 may include, for example, a long side or a side not comprising large openings. The length of the device (e.g., the length of side 110 from end 105*a* to end 105*b*) may be, for example, more than about 1 foot, 2 feet, 3 feet, 5 feet, 10 feet, 15 feet, 20 feet, 30 feet, 40 feet, 50 feet, 75 feet, 100 feet or more, for example. The length of the device (e.g., the length of side 110 from 105*a* to 105*b*) may be, for example, less than about 1 foot, 2 feet, 3 feet, 5 feet, 10 feet, 15 feet, 20 feet, 30 feet, 40 feet or 50 feet. The length of the device (e.g., the length of side 110 from 105*a* to 105*b*) may be, for example, about 1 foot, 2 feet, 3 feet, 5 feet, 10 feet, 15 feet, 20 feet, 30 feet, 40 feet or 50 feet. It should be noted that the device 100 illustrated in FIG. 1 can be the only segment or one of multiple segment of a containment system or containment device. The containment device or system can be of any suitable length according the region that is to be partially or completely contained. In some aspects, a single continuous device can be used. In other aspects multiple devices (or segments) can be joined to at least partially surround the region.

The device 100 may be configured such that ends of one device 100 can connect to ends of another device 100. In some embodiments, an internal coupling and/or one or more bands (e.g., wrap-around bands) may be used to connect devices 100. A sealant may be used to help prevent leakage between the devices 100.

The device 100 may include one or more openings 115. The openings can be of any desirable shape and/or size. For example the shape and/or cross section of the openings may be circular, square, rectangular, triangular, elliptical or any other shape. These openings 115 may be, for example, smaller than the dimensions of the first and/or second ends 105. The openings 115 may be substantially regularly spaced across a length of the device 100. The distance between adjacent openings 115 may be, for example, more than about 1 inch, 6 inches, 1 foot, 2 feet, 3 feet, 4 feet, 5 feet, 6 feet, 7 feet, 8 feet, 9 feet, 10 feet, 15 feet, 20 feet, 50 feet or more, for example. The distance between adjacent openings 115 may be, for example, less than about 1 inch, 2 inches, 6 inches, 1 foot, 2 feet, 3 feet, 4 feet, 5 feet, 6 feet, 7 feet, 8 feet, 9 feet, 10 feet, 15 feet, 20 feet, 30 feet, or 50 feet. The openings 115 may be of any appropriate size. In some instances, a dimension of the openings 115 is at least about ½ inch, 1 inch, 2 inches, 3 inches, 4 inches, 5 inches, 6 inches, 8 inches, 10 inches, one foot, 2 feet, three feet or more, for example. In some instances, a dimension of the openings 115 is less than about ½ inch, 1 inch, 1 inch, 2 inches, 3 inches, 4 inches, 5 inches, 6 inches, 8 inches, 10 inches, 1 foot, 2 feet or 3 feet, for example.

In some instances, such as that shown in FIG. 1, the openings 115 are located at a similar position with respect to a cross-sectional shape of the device 100. Thus, the openings 115 may then be aligned. For example, the openings 115 may be positioned in straight line relative to each other, and in some aspects, for example, they can be positioned in a line that runs parallel to an axis of the device 100. Such alignment may make it easier to fill the device with a substance through the holes. In other instances, the openings 115 are located at different positions with respect to the cross-sectional shape. This may allow the substance to fill different portions (e.g., a front and back portion) of the device, which may cause a more even weight distribution.

A fillable device may include, for example, a device comprising a cavity configured to be at least partially filled with a substance, such as a weighting substance. In some instances, the device can include, for example, one or more openings or holes to allow access to the cavity. Thus, a substance may enter the openings or holes to fill the cavity. More details with regards to the openings or holes are described below.

The device may include, for example, any appropriate material. In some instances, the device can include, for example, a plastic. The material may be non-corrodible and/or corrosive, which may be advantageous particularly in environments including salt water and/or hydrogen sulfide gas. The material may be resistant to degradation, for example, UV degradation, such as high density polyethylene (HDPE). The material may comprise a metal, such as steel, iron, titanium, copper, or aluminum. In some instances, the material may repel a liquid, such as water. In some instances, the device comprises a material to absorb a liquid, such as oil. In some embodiments, the liquid is hazardous; in some embodiments, the liquid is non-hazardous. The material may be rigid, semi-rigid or flexible, for example. In some instances, a preformed component is modified to form a fillable device 100. For example, a pipe or culvert may be modified to, for example, include the openings 115 to become the fillable device 100.

Figure 2A:
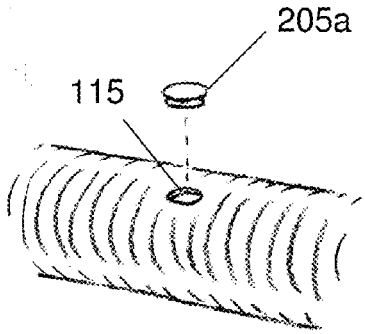
FIGS. 2A-2C show various coverings configured to cover openings of a fillable device.
Figure 2B:
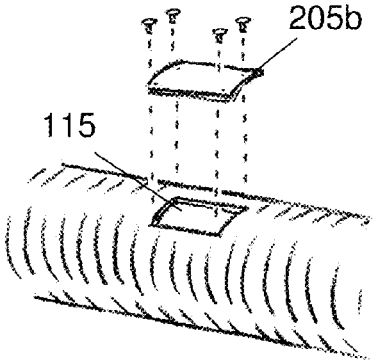
Figure 2C:
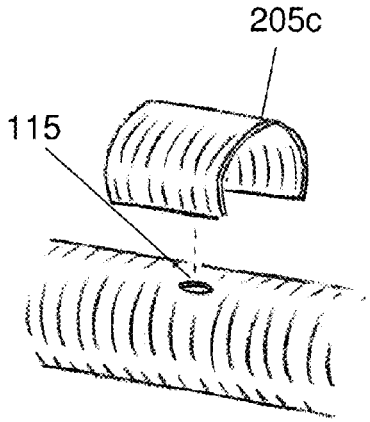

As shown in FIGS. 2A-2C, a covering 205 may be provided to cover an opening 215 of the device 100. The covering 205*a* may be configured to be inserted into the opening 215, as shown in FIG. 2A. The covering 205*a* may include, for example, a bottom portion configured to be inserted into the opening 115 and a top portion configured to rest on a surface of the device 100. Depending on the embodiment, the bottom portion may be configured such that it will loosely or snuggly fit in the opening 115. The top portion may include, for example, a larger cross section than a bottom portion. The covering 205*a* and the opening 115 may be configured such that the covering 205*a* can snap into the opening. In some instances, the cross-section of the covering remains substantially the same. In these cases, the covering 205*a* may be long or may be configured to be a tight fit within the opening 115, such that it is unlikely that the covering 205*a* can be completely inserted or fall through the opening 115, and a top un-inserted portion will likely remain following insertion of the covering 205*a*.

A covering 205*b* may be attached to a device 100, as shown in FIG. 2B. Additional components, such as pegs, screws, nails or an adhesive may be used to attach the covering 205*b* to the device.

A covering 205*c* may be configured to overlie the opening 115, as shown in FIG. 2C. In some instances, the covering 205*c* can include a shape similar to or that matches the contour and/or shape of the device 100. The covering 205*c* may include, for example, a lap over cover or saddle cover. The covering 205*c* for example, wrap around at least a portion of the device 100, which may, for example, anchor the covering 205*c* to the device 100.

In some embodiments, the covering 205 may include one or more of a wedge, a lid and a flap.

FIGS. 2A-2C show coverings 205 configured to cover a single opening 115. In some embodiments, a covering 205 can covers a plurality of openings 115. For example, the covering 205*c* from FIG. 2C may be extended to a longer length, such that it would cover a plurality of openings 115. Coverings 205*a* or 205*b*, shown in FIG. 2A or 2B, respectively, may be connected to adjacent coverings. In these instances, it may not be necessary to individually position a covering 205 over each opening 115.

Figure 3A:
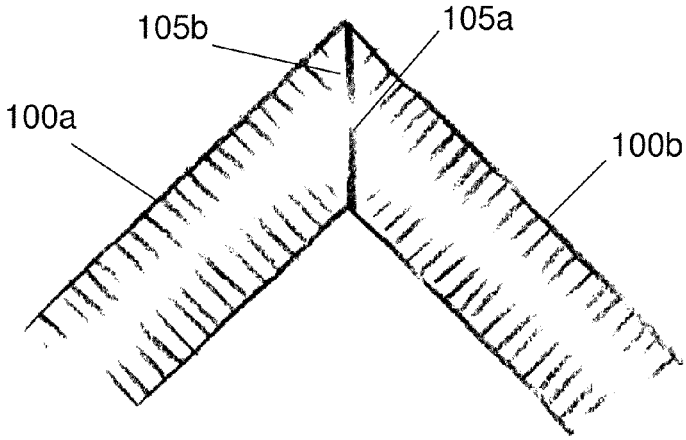
FIG. 3A shows two fillable devices being positioned to form a corner and FIGS. 3B and 3C show illustrative curved fillable devices.
Figure 3B:
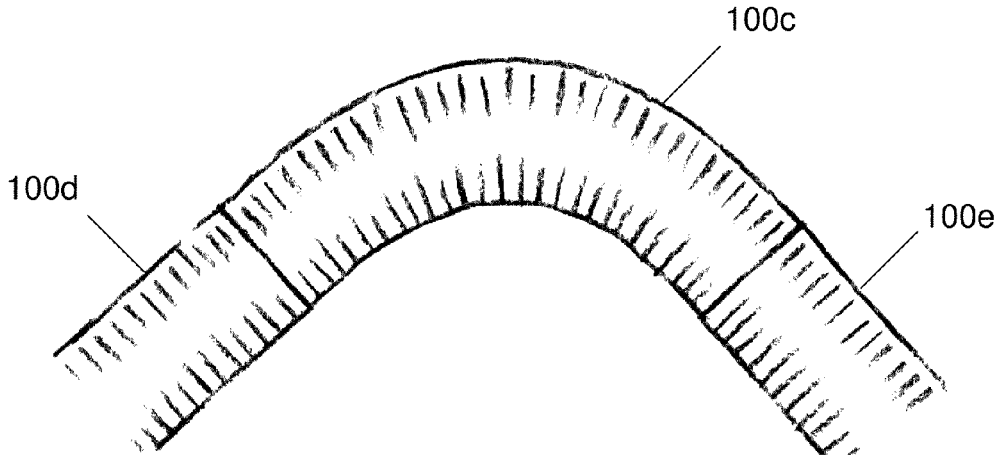
Figure 3C:
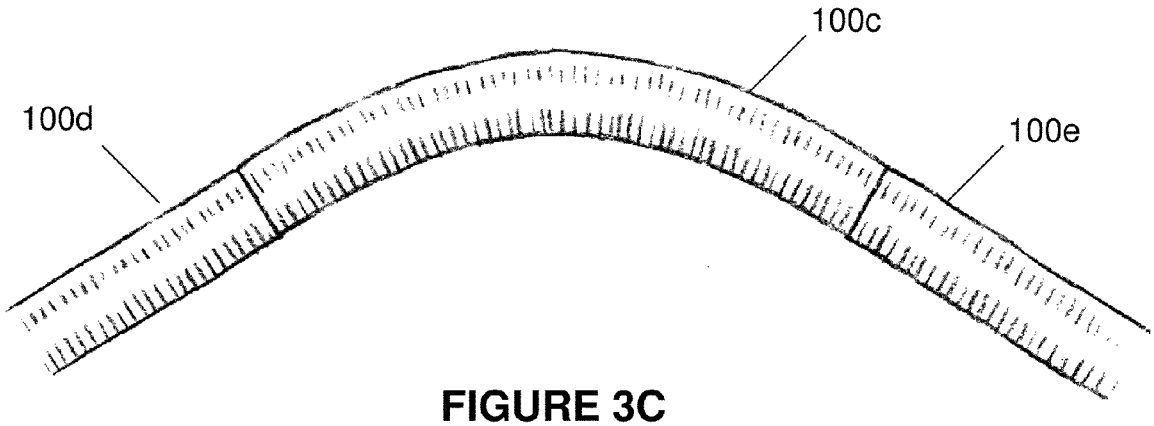

FIG. 1 shows an embodiment in which the fillable device 100 is substantially straight (e.g., a straight tube). In other embodiments, the device may include, for example, one or more of a curve or corner, as shown in FIGS. 3A-3C. In some embodiments, a single device can include a corner (e.g., a square corner). In other embodiments, two devices 100*a* and 100*b* are positioned to form a corner, as shown in FIG. 3A. In some of these instances, one or both of the device's first and second ends 105*a* and 105*b* are not normal to the side 110 (not shown in FIG. 3, but see FIG. 1) of the device. For example, the ends 105*a* and 105*b* may be at about a 45 degree angle with respect to the side 110. Depending on the configuration of the devices, both ends 105 may be substantially non-normal to the length or only one end 105 may be non-normal. In FIG. 3A, a non-normal second end 105*b* of a first device 100*a* is positioned adjacent to a non-normal first end 105*b* of a second device 100*b*. The devices 100*a* and 100*b* may or may not be connected to each other. In some embodiments, the devices 100*a* and 100*b* are configured to interlock. In some embodiments, one or more internal couplings and/or bands (e.g., wrap-around bands) may be used to connect devices 100*a* and 100*b*. A sealant may be used to help prevent leakage between the devices 100*a* and 100*b*. A separate component may also be used to attach the devices 100*a* and 100*b* together. While FIG. 3A shows two devices being positioned to form a right angle, other types of corners (e.g., non-right angle corners, such as for example about 45-degree to about 160-degree corners) may also be formed. In some embodiments, an additional device may be positioned between the second end 105*b* of the first device 100*a* and the first end 105*a* of the second device 100*b*. The additional device may have a cross section different from that of the first and second device 100*a* and 100*b*.

FIG. 3B shows a curved device 100*c*. As shown, the curved device 100*c* may be configured to connect two devices (e.g., two straight devices) 100*d* and 100*e*. In some aspects a single device can be used that has curvature, rather than the depicted three devices that are connected, though multiple devices may provide advantages of ease of transporting each device to the location and/or customizing the shape of the containment device. In some instances, a positional angle difference is determined between one or more devices or two or more portions of a device 100. The positional angle difference is the angular difference between lines running tangential to a side 110 (not shown in FIG. 3, but see FIG. 1) of the devices or device portions. Thus, in FIG. 3B, the positional angle difference between devices 100*d* and 100*e* is approximately 90 degrees. However, in other embodiments, the curved device 100*c* can be configured to produce different positional angle differences between devices connected to the curved device 100*c*. FIG. 3C shows an embodiment in which the curved device 100*c* comprises a more gradual turn than that from FIG. 3B. The curved device 100*c* may be characterized by a radius, which can relate to how sharply a turn occurs. For example, a radius of curved device 100*c* of FIG. 3A is longer than a radius of curved device 100*c* of FIG. 3B, indicating a more gradual turn.

In some instances, the devices can be manufactured with a particular curve. In other embodiments, the devices 100 can be at least partly flexible, such that they can be bent around a desired shape or bent to be a desired shape.

In some embodiments, corner devices (e.g., 100*c* or a single device that includes or incorporates both 100*a* and 100*b*) and/or cornering defining devices (e.g., 100*a* or 100*b*) can include openings (for example similar to openings 115 of FIGS. 1-2), while in other embodiments they do not.

It may be necessary for people to enter and exit an area enclosed by a containment device or system. Thus, in some embodiments, a containment system can include, for example, one or more steps 405. In some embodiments, a fillable device 100*f* can include steps 405, as shown in FIG. 4. The fillable device 100*f* comprising the steps 405 may be configured, for example, to attach to other fillable devices 100. For example, the device may include, for example, one or more ends 105 configured to interlock with or connect to ends 105 of other devices. In some instances, the fillable device 100*f* that includes the steps 405 may include bracing, e.g., inside the device 100*f*. The bracing may run in a direction along the length or along the side 110 of the device 100*f*. Thus, a substance that fills the device 100*f* may flow into adjacent devices and vice versa.

The number of steps may depend, for example, on the diameter of the device 100*f* and/or the step depth. In some instances, the number of steps is at least about, approximately, or less than about 1, 2, 3, 4, 5, 6, 7, 8, 9, 10, 15, 20, 30, or 50 steps. The number of steps may include, for example, an odd number. The step depth is defined as a length of a step 405 in direction perpendicular to the side 110 of the device, and it may be at least about, approximately, or less than about 6 inches, 8 inches, 12 inches, 18 inches, 24 inches, 30 inches or 36 inches. In one embodiment, the device diameter is about 2 feet, the step depth is about 12 inches and the number of steps is 3.

Figure 4A:
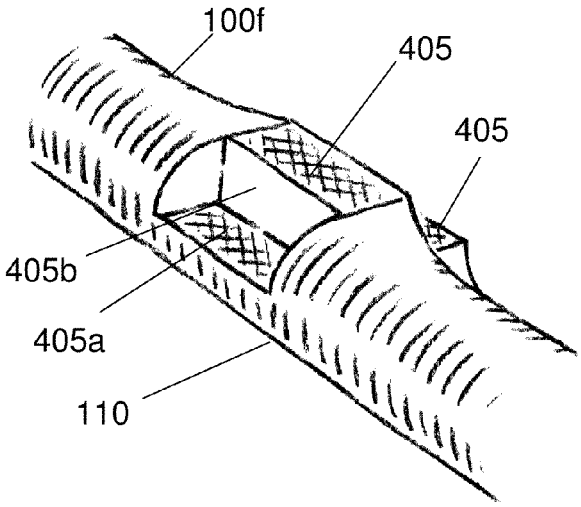
FIGS. 4A-4C show illustrative fillable devices that include steps.
Figure 4B:
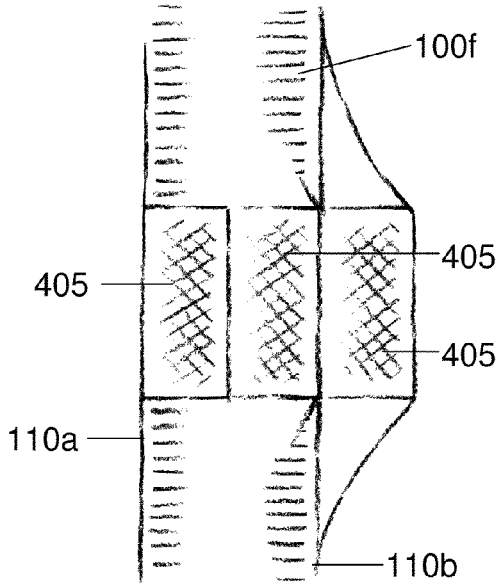
Figure 4C:
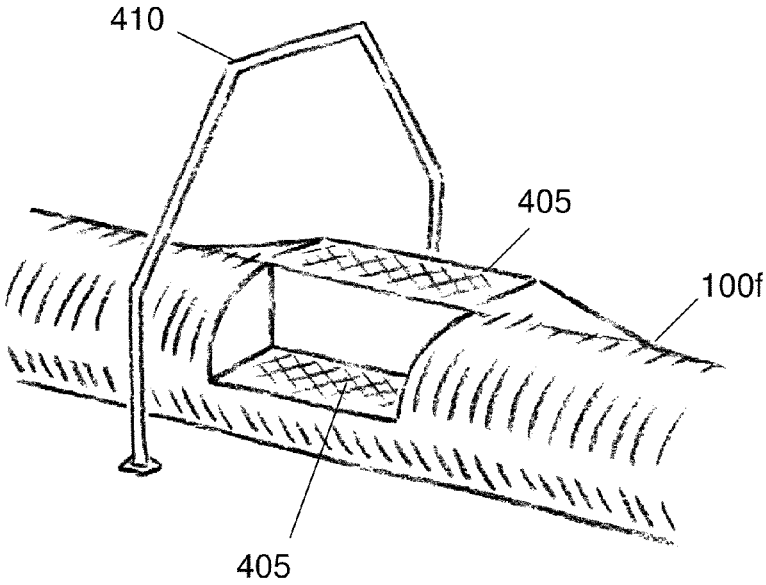

In some embodiments, the highest step 405 is of substantially the same height or is substantially aligned with the height of the device 100*f* or of an adjacent device 100, as shown in FIGS. 4A and 4C. In other instances, the highest step is higher or lower than the height of the device 100*f* or of an adjacent device 100.

One or more steps 405 may include, for example, one or more openings 115. The openings 115 may be, for example, through a bottom portion 405*a* of the steps 405, the bottom portion 405*a* being that on which a person would be expected to step on. In some instances, only the higher or highest steps 405 comprise one or more openings 115.

In some embodiments, the total depth across the steps 405 can be approximately equal to the diameter of the device 100*f*. In some embodiments, the total depth across the steps 405 is wider than the diameter of the device 100*f*. Such may occur depending on determined step depth, step height and/or step number. For example, if steps 405 are one foot deep and one foot high and the device 100*f* has a 2-foot diameter, three steps may be used and thus the total step depth of 3 feet exceeds the 2-foot diameter. In these instances, the device 100*f* may be constructed such that the steps 405 are flush with respect to one side 110*a* of the device, as shown in the top-down view of the fillable device 100*f* comprising steps 405 in FIG. 4B. The steps 405 may extend beyond a second side 110*b*. The second side 110*b* may be a side towards the center of a region being at least partly contained by the device 100*f*. This configuration may prevent vehicles, graders, transports, etc. from running over the steps. In other embodiments, the steps extend beyond both sides 110*a* and 110*b* of the device.

In some embodiments, the steps 405 are closed, while in others, they are open. For example, a back surface 405*b* of the steps may be a solid material (possibly with openings 115) or may be open. The bottom surface 405*a* of the steps may include, for example, a heavy-duty metal screen. The screen may thereby include openings 115 that would allow a substance to enter a cavity of the device 110*f*. The steps may include, for example, traction grips, grates, or molded in traction grips.

A support structure 410 may also be provided. The support structure 410 may include, for example, a hand rail. The support structure 410 may be anchored and/or installed into the ground, as shown in FIG. 4C, or it may be a part of the device 110*f*. For example, support structures 410 may extend out of the top of the device 100*f*. The support structure 410 may allow for people using the steps to maintain their balance. The support structure 410 may be anchored and/or attached to a fillable device and/or a step 405.

Figure 5A:
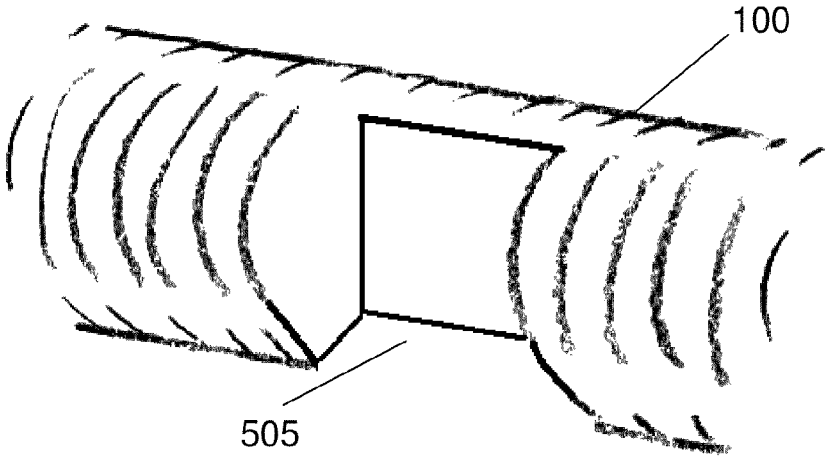
FIGS. 5A-5B show an illustrative embodiment that includes a step insert component positioned in a void of a fillable device.

FIG. 5A shows an embodiment in which a portion of a fillable device 100 is removed to form a space 505. The space may be formed, for example, by making a first cut in the device 100 crossways up to, for example, the highest point of the device 100. A second cut may then be made parallel to the first cut. The distance between the first and second cuts may define or constrain the width of steps 405. A third cut may be made to connect top ends of the first and second cuts and a fourth cut to connect the bottom ends of the first and second cuts. These cuts may separate a section of the device 100 from the remaining portion of the device 100. The section may include, for example, a cross section with an area of about ¼, ⅓, or ½ times the cross-sectional area of the device 100. In some embodiments, the first and second cuts go entirely through the device 100 and the third and fourth cuts are not made.

Figure 5B:
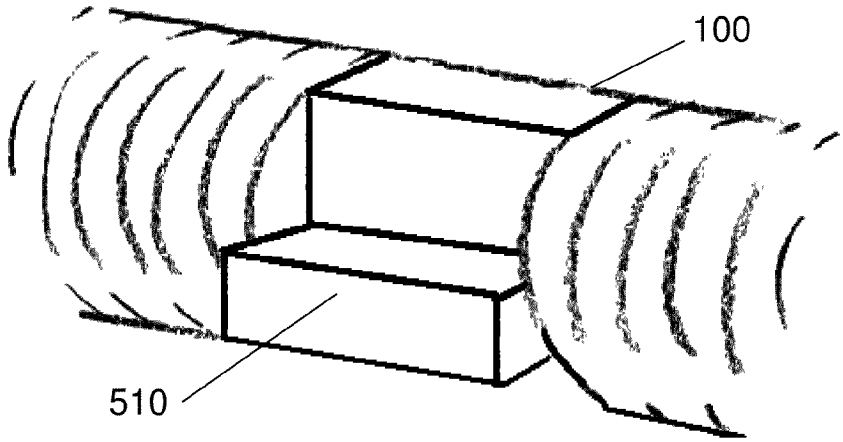

A step insert component 510 can be positioned within the void, as shown in FIG. 5B. In some embodiments, a portion of the step insert component 510 may overlap with a portion of the device 100. The step insert component 510 may be positioned at least partly in the space 505, such that steps are inset into the device 100 (e.g., for about half of the device 100). The step insert component 510 may be attached to the device 100, for example, by glue, screws, etc.

Figure 5C:
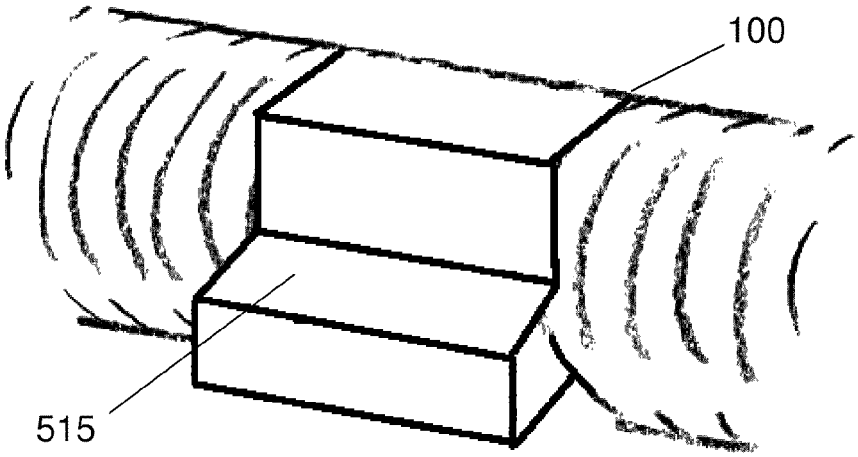
FIG. 5C shows a step overlay component positioned over a fillable device.

As shown in FIG. 5C, a step overlay component 515 can be positioned over a portion of a device adjacent to the step insert component 510 or adjacent to a space 505 formed as described above with respect to FIG. 5A. In some embodiments, a single step component can include both the step insert component 510 and step overlay component 515. In some embodiments, the step overlay component 515 extends beyond the device 100 to, for example, accommodate extra step width.

In some embodiments, a step component (e.g., the step component 605 shown in FIG. 6) may be placed over a fillable device 100 or another round structure (e.g., a structure with a shape similar to the device or that fits over the device, for example, a cylinder, a culvert, a structure with a shape similar to a sphere, etc.). A portion of the step component may include, for example, a shape similar to that of the fillable device 100. For example, the step component 605 may include, for example, a curved cross section. A radius of curvature of the step component 605 may be slightly larger than a radius of curvature of the device 100, such that the step component 605 may at least partly wrap around the device 100. The radius of the step component 605 may be, for example, more than about, about, or less than about 6 inches, 8 inches, 10 inches, 12 inches, 14 inches, 16 inches, 18 inches, 20 inches, 22 inches, 24 inches, 26 inches, 30 inches, or 36 inches. The step component 605 may be attached to the device, for example, with an adhesive, a sealer, screws, tabs, etc. In some embodiments, the shape of the step component 605 serves to at least partly secure the step component 605 to the device 100. For example, the step component may snap onto the device 100. The step component 605 may include, for example, a supporting section (e.g., a portion with a shape paralleling a shape of the fillable device 100) and may include, for example, steps 405. The steps may be over, on and/or adjacent to the supporting section. In one embodiment, the steps are positioned on the supporting section. In one embodiment, no portion of the step component is below the steps. The steps may then, for example, include openings 115, such that a substance may fill the steps and/or an underlying device 100. The steps may be solid or hollow. In some instances, the steps comprise openings 115. In the example shown in FIG. 6, the steps 405 are flush with both sides of the device 100. In some embodiments, the steps extend beyond one or both sides of the device 100. In some embodiments, the step component 605 is centered on the device 100, such that the steps 405, for example, are substantially parallel to the ground.

In some embodiments, the step component 605 and void are configured such that the step component 605 is slightly bigger in one or more dimensions than the void. Thus, the step component 605 may overlap the device 100. The amount of overlap may be any appropriate length, such as at least about, approximately or no more than about ½ inch, 1 inch, 2 inches, 3 inches, 4 inches, 5 inches, 6 inches, 8 inches, 10 inches, 12 inches, 18 inches, or 24 inches. In some conditions (e.g., when the step component 605 comprises a slightly flexible or flexible material), the overlap may be long enough to ensure that the component 605 does not fall into the void. In some instances, the component 605 is configured such that one or both of a front side (e.g., a side facing the outside of a containment region) and a back side (e.g., a side facing the inside of a containment region) extend to be at or near the ground. Similarly, the step overlay component 515 may be configured to overlap the device 100.

Figure 6:
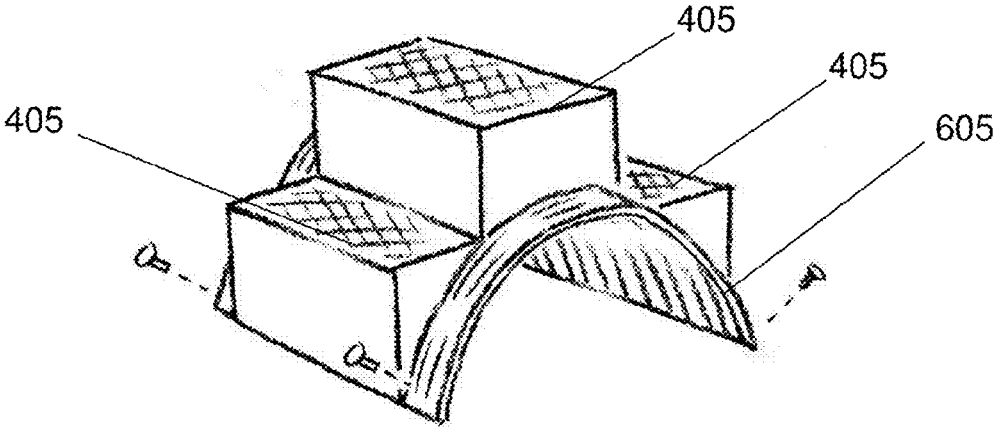
FIG. 6 shows a step component that may be positioned over a fillable device.

Although steps are shown in FIGS. 5-6, it should be noted that in some embodiments, the devices can include other mechanisms that permit a person, apparatus or device to cross the devices. For example, rather than steps, a ramp can be used which would allow one to cross, and may allow for an object having wheels to go up and over the device.

The step insert component 510, step overlay component 515 and/or the step component 605 may include, for example, a material similar to or the same as a material of the device 100. For example, the step component may include, for example, HDPE and/or metal (such as, e.g., steel, iron, titanium, copper, or aluminum). The step insert component 510, step overlay component 515 and/or the step component 605 may include, for example, one or more openings 115.

Many facilities have tanks or fluid storage units with valves located near the bottom where fluid is removed from the tanks or storage units. For example, in oil fields, a "connection" valve can be located about one foot up from the bottom of a stock tank on the front side of the tank. When fluid is to be removed from the fluid storage unit (e.g., when a tank of oil is sold), a hose may be connected to this valve (usually 2" or 3") and fluid removed from the unit. However, when a containment structure (e.g., a dike) surrounds the unit, operators (e.g., truck drivers) then frequently climb over the structure to connect a hose to the valve. An alternative strategy is to position part of a pipe, conduit, tube or manifold through or over the containment structure and connect an end of the pipe, conduit, tube or manifold to one or more storage unit valves. The pipe, conduit, tube or manifold may include, for example, a valve on an end outside of a contained region. In some instances, valves are on or near the storage units (e.g., a receiving end) and on or near an output end (e.g., an end to be connected to a truck transport). By closing a valve on the output end, fluid (e.g., oil) remaining in the pipe, conduit, tube or manifold may be contained with the pipe, conduit, tube or manifold (e.g., after a hose is disconnected from the output end) instead of draining outside of the containment region.

Figure 7A:
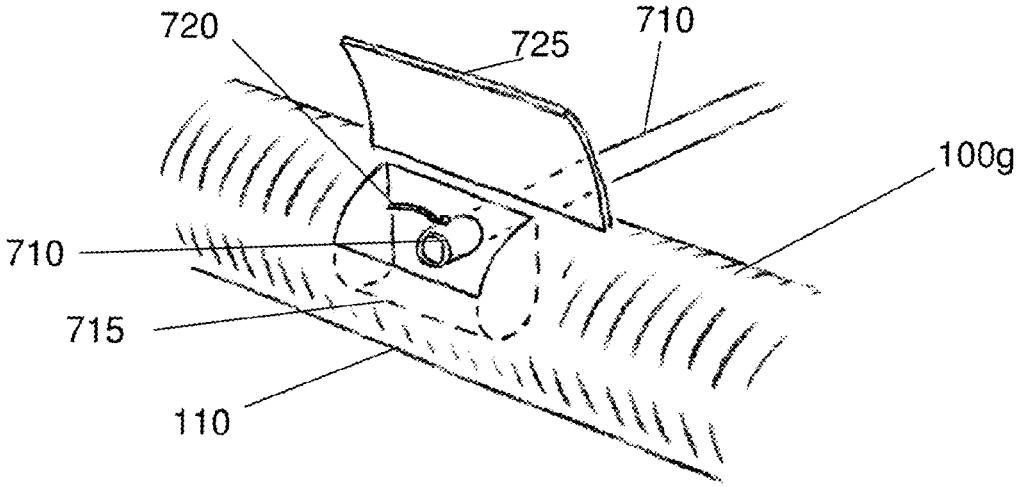
FIGS. 7A-B show illustrative tank connection fillable devices that include a sleeve for a fluid transportation unit.
Figure 7B:
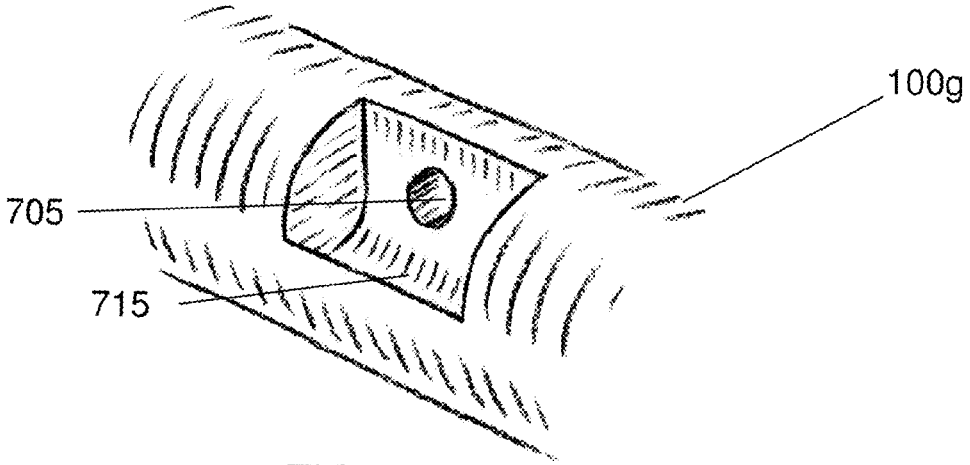

In some embodiments, a tank connection fillable device 100*g* is provided, as shown in FIGS. 7A and 7B. The tank connection fillable device 100*g* may include, for example, a sleeve 705. The sleeve 705 may extend through at least a portion of the tank connection fillable device 100*g* in, for example, a width-wise direction. The sleeve 705 may include, for example, an input end and an output end. In some instances, an end of a fluid transportation unit 710 (e.g., a pipe or hose), which may, for example, be connected to a fluid storage structure, is inserted into an end of the sleeve 705 or inserted through the sleeve 705. Different adapters may be used to, for example, allow different sizes of fluid transportation units 710 to be used without having to have different sizes of sleeves 705. In some embodiments, properly sized rubbers, o-ring type materials or other gasket like materials may be used to provide a "seal" between the fluid transportation unit 710 and the sleeve 705 and/or to prevent any containment fluids from leaking through the sleeve 705. Such sealing components may be, for example, slipped over the fluid transportation unit 710 where it enters the sleeve 705. In some instances, the sleeve 705 a flexible material, such as rubber, an o-ring type material or other gasket-like material is positioned between the fluid transportation unit 710 and the sleeve 705 (e.g., by positioning the material over the fluid transportation unit 710) prior to inserting the unit 710 into the sleeve 705. Thus, when a fluid transportation unit 710 is inserted into or through the sleeve 705, the position may be slightly adjusted due to these flexible materials. The flexible material may absorb effects of movements (e.g., settling, bumping into, expansion, etc.), which may otherwise break or crack a structure sealing the position of the sleeve 705 (e.g., a cementing fixing structure). As such a break or crack may cause a leak, the flexible material may serve to reduce or prevent leaks.

In some embodiments, a pipe, connection, conduit or tube can be used in place of the sleeve 705. In these instances, the sleeve 705 may be configured to connect (e.g., via an input end) to a fluid transportation unit 710. In some embodiments, an input end of the sleeve 705 connects or attaches to an output end of the fluid transportation unit 710. In some embodiments, the device 100*g* comprises two holes, one at an inside surface and one at an outside surface of the device 100*g*, instead of the sleeve 705. The fluid transportation unit 710 may then enter one hole and exit another hold, thereby passing through or transversing the device 100*g*. This embodiment may be used, for example, in conditions in which the tank connection fillable device 100*g* is not completely filled with a substance.

In some embodiments, the tank connection fillable device 100*g* may include, for example, a drip catching structure 715. The drip catching structure 715 may include, for example, a basin, well or inset configured to capture, absorb and/or hold liquid. The drip catching structure 715 may be provided within a center portion of the device 100*g* or may be protruding out (not shown) of the device 100*g*. The sleeve 705 may be located above the drip catching structure 715, such that, for example, the drip catching structure 715 could contain liquids dripped or spilled from an end of the sleeve 705 so they are not spread into the inside or outside of a containment region. Fluid can be removed from the drip catching structure 715 as determined necessary, regularly or as needed.

Referencing FIG. 7A, in some instances, a drip catch cover 725 can be provided to cover the drip catching structure 715. The drip catch cover 725 may, for example, be hinged to (e.g., the top or side) of the drip catching structure 715. The drip catch cover 725 may include, for example, a material similar to that of the main component of the fillable device. The drip catch cover 725 may include, for example, HDPE or a metal. The hinges may be attached to a device or may be molded into the device, which may be more resistant to corrosive environments than other hinges. The drip catch cover 725 may include, for example, a heavy material or may be weighted, which may prevent moderate and/or strong winds from lifting the cover 725. A latch or lock may be provided to keep the drip catch cover 725 closed. A latch or lock may be provided to keep the drip catch cover 725 open. A lock may help prevent or reduce vandalism and/or theft. The drip catch cover 725 may prevent or reduce the amount of dirt, ice, rain, debris or other natural substances from accumulating, for example, in the drip catching structure 715.

The tank connection fillable device 100*g* may include, for example, a valve 720. The valve 720 may be configured to be attached to a liquid transportation unit 710 or may be on the liquid transportation unit 710. The valve 720 may control the flow of a fluid from the liquid transportation unit 710 through an output end of the liquid transportation unit 710 or of the sleeve 715. The valve 720 may be configured such that removal of, for example, a hose from the output end of the sleeve 715 does not result in any or a substantial amount of liquid dripping from the sleeve 715.

The tank connection fillable device 100*g* may include, for example, a material, shape and/or dimensions similar to non-tank connection fillable devices (e.g., device 100 shown in FIG. 1). The tank connection fillable device 100*g* may include, for example, ends to connect to or attach to other fillable devices (e.g., device 100 or any of devices 100*a-f*). The tank connection fillable device 100*g* may include, for example, bracing or support inside the device 100*g*, which may, for example, run in the direction of a side 110. This configuration of the bracing or support may allow, for example, a fillable substance introduced in the tank connection fillable device 100*g* to spread to adjacent devices or vice versa. In some embodiments, the tank connection fillable device 100*g* may include openings (for example, similar to the openings 115 of FIG. 1), which may be positioned along a top portion of the device 100*g*.

Figure 8A:
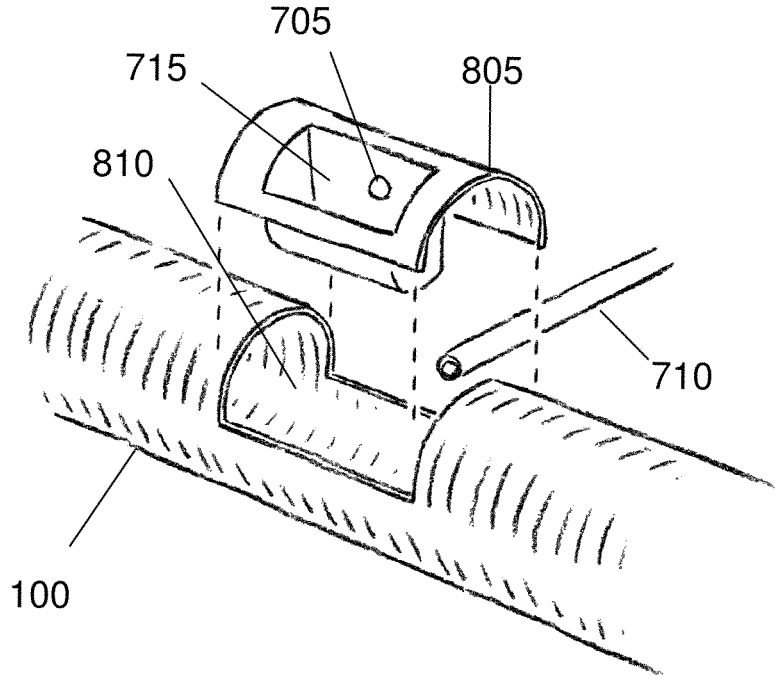
FIGS. 8A-8C show an illustrative process for making a tank connection fillable device using a tank connection component.
Figure 8B:
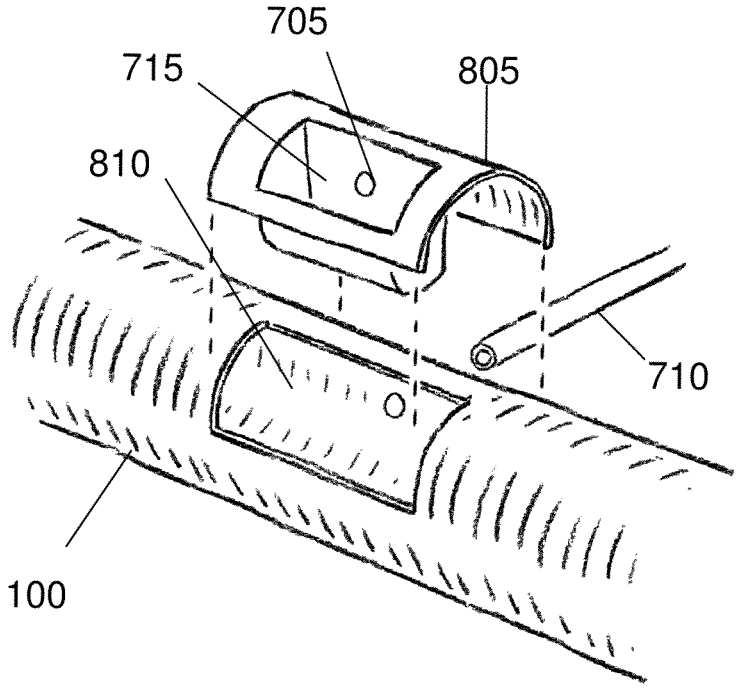
Figure 8C:
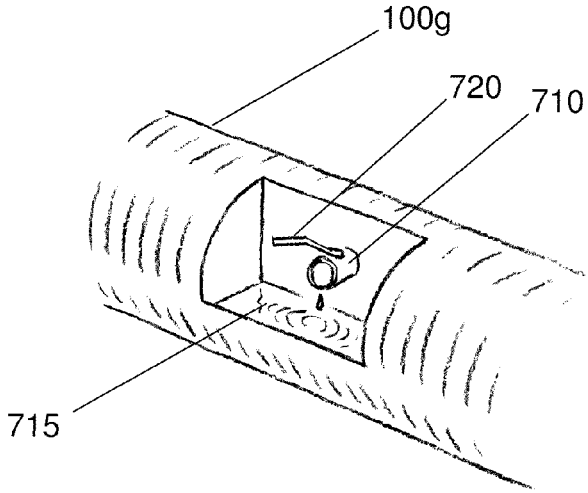

FIGS. 8A-8C show examples, without being limited thereto, of one set of some of the components that can be used in making a tank connection fillable device 100*g* and an example of one process for making a tank connection fillable device 100*g* using a tank connection component 805. First, a segment is removed from a fillable device 100. The segment may be removed by, for example, a first cut may be made width-ways through a top portion of the device. A second cut may be made width-ways, substantially parallel to the first cut and to a substantially similar depth. The first and second cuts may be substantially symmetric across a middle length-wise axis, as shown in FIG. 8A or may asymmetrically extend (or be entirely) within a half of the device 100 facing away from a containment region (e.g., within an exterior half), as shown in FIG. 8B.

Third and forth cuts may connect the back and front ends of the first and second cuts. Thus, a void 810 is formed. A tank connection component 805 may then be inserted into the void 810.

The tank connection component 805 may include, for example, a sleeve 705 and a drip catching structure 715, as described with reference to FIGS. 7A-B. A fluid transportation unit 710 may then be inserted, for example, through the sleeve 705 and the fluid exiting the unit 710 through an output end may be controlled by valve 720, as described in further detail above. FIG. 8C shows an embodiment that may result from a process where a segment is removed from a fillable device and a tank connection component is inserted into the void, as described herein. The tank connection component may be configured to fit snuggly into the void such that there is no overlap, though alternative arrangements are provided in other embodiments. In some instances, when a fillable device is originally being manufactured, it may be configured to allow for fluid transportation through (e.g., transversely through) the device. The device may be manufactured directly as shown in FIG. 8C as to, for example, include the sleeve 705 and/or the drip catching structure 715.

In some embodiments, the tank connection component 805 and void 810 are configured such that the tank connection component 805 is slightly bigger in one or more dimensions than the void 810. Thus, the tank connection component 805 may overlap the device 100. The amount of overlap may be any appropriate length, such as at least about, approximately or no more than about ½ inch, 1 inch, 2 inches, 3 inches, 4 inches, 5 inches, 6 inches, 8 inches, 10 inches, 12 inches, 18 inches, 24 inches or more as desired. In some conditions (e.g., when the tank connection component 805 includes or is made from a slightly flexible or flexible material), the overlap may be long enough to ensure that the component 805 does not fall into the void 810, for example. In some instances, the component 805 may be configured such that one or both of a front side (e.g., a side facing the outside of a containment region) and a back side (e.g., a side facing the inside of a containment region) extend to be at or near the ground. In conditions where the void 810 is contained entirely or primarily within the front side of the device 100, the overlap may extend to the back side of the device. The tank connection component 805 may be secured to the device, for example, by a sealer, screws, or an adhesive. In some embodiments, the shape of the tank connection component 805 serves to secure the tank connection component 805 to the device 100. For example, the tank connection component 805 may snap onto the device 100.

A portion of the tank connection component 805 may include, for example, a shape similar to that of the fillable device 100. For example, the tank connection component 805 may include, for example, a curved cross section. A radius of curvature of the tank connection component 805 may be slightly larger than a radius of curvature of the device 100, such that the tank connection component 805 may at least partly wrap around the device 100. The radius of the tank connection component 805 may be, for example, more than about, about, or less than about 6 inches, 8 inches, 10 inches, 12 inches, 14 inches, 16 inches, 18 inches, 20 inches, 22 inches, 24 inches, 26 inches, 30 inches, or 36 inches. The tank connection component 805 may include, for example, openings 115.

In some instances, the tank connection component 805 may be positioned over a round structure (e.g., a structure with a shape similar to a cylinder, a culvert, a structure with a shape similar to a sphere, etc.) other than the fillable device.

Figure 9:
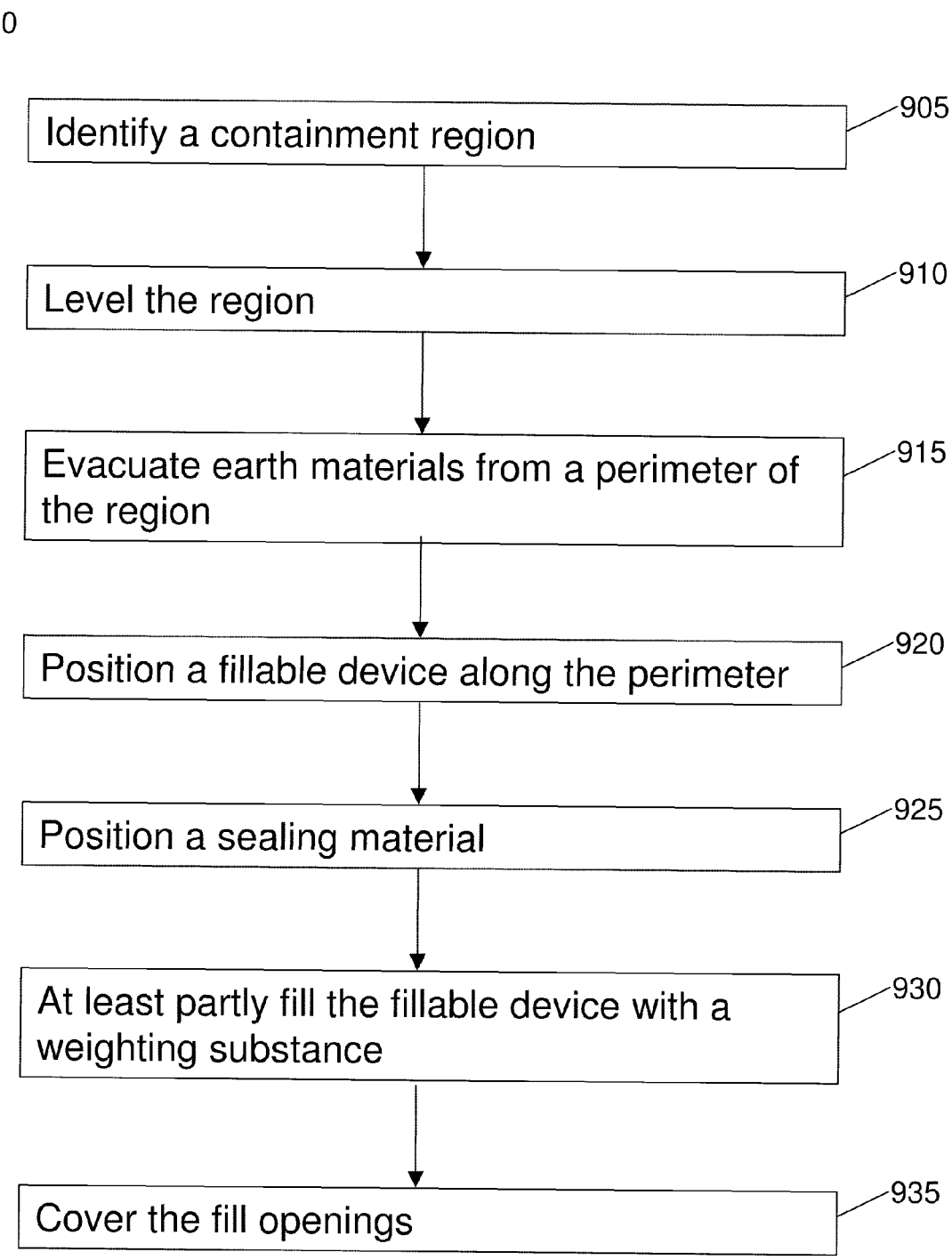
FIG. 9 shows a process for forming a containment system.

FIG. 9 shows an example of an illustrative process 900 of forming a containment system. In some embodiments, steps of the process may be deleted, added, supplemented, or rearranged.

At step 905, a containment region is identified. The region may be one that includes, for example, a fluid storage unit, such as an oil tank, one housing an environmentally hazardous material, and/or any other material that one desires to contain. In some embodiments, identification of the region can include calculating the size or perimeter of the region.

At step 910, the region is at least partially leveled. Leveling may prevent, for example, fluids from flowing from a high area to a low area and possibly overflowing a containment structure. In some instances (e.g., when the region is already approximately level), process 900 does not include step 910. The degree to which a region is leveled can depend upon the potential amount or volume of material that is to be contained. For example, in some instances the region can be less than completely level, thereby permitting some spilled material to be present in greater amount at one part of the containment region. However, not present in such a great amount that it will spill out of the containment region or over the device.

At step 915, earth materials are evacuated from the perimeter of the region. Earth materials may include, for example, dirt, sand, rock, grass, etc. The earth materials may be removed, for example, to a depth of at least about, about or less than about 1 inch, 2 inches, 3 inches, 4 inches, 5 inches, 6 inches, 8 inches, 10 inches or 12 inches. In some instances the materials are removed to a depth of approximately 2 inches to approximately 6 inches. The materials may be removed in such a way that a rounded shaped trough or indentation is formed, such that rounded fillable devices 100 may be positioned within indentations formed by the evacuations. The evacuation may allow fillable devices 100 to settle into the ground, to help prevent leaking from underneath the devices 100 and/or to prevent the fillable devices 100 from rolling. It should be noted that in some aspects, step 915 can be deleted from the process.

At step 920, a fillable device is positioned. In some instances, a plurality of fillable devices 100 can be positioned, for example, around the perimeter. The devices 100 may be connected to adjacent devices 100 as described above. In some embodiments, straight fillable devices (e.g., the device 100 shown in FIG. 1) are positioned. In some instances, corner or curved devices (e.g., those shown in connection with FIGS. 3A-3C), step devices or components (e.g., those shown in connection with FIGS. 4-6), and/or tank connection devices or components (e.g., those shown in connection with FIGS. 7-8) are positioned. As described in greater detail above, in some embodiments, devices 100 may be positioned and then a void may be formed within one or more devices such that a component (e.g., a step component 605 or tank connection component 805) may be positioned within the void.

At step 925, a sealing material can be positioned. In some embodiments, the sealing material is positioned before the fillable devices 100 are positioned, and the fillable devices 100 are positioned, for example, on or over the sealing material. In other instances, the sealing material is positioned adjacent to the fillable devices 100 after the devices 100 have been positioned. The sealing material may reduce or prevent, for example, liquid from seeping or travelling underneath the device 100. The sealing material may include, for example, dirt, natural clays, bentonite, asphalt (e.g., asphalt chips), rubber, chemicals, liners, etc.

At step 930, the fillable device 100 can be at least partly filled with a weighting substance. The device 100 may be filled through openings 115. In some instances, all devices 100 positioned in step 925 are at least partly filled, while in others, only some are filled. In some instances, step devices and/or tank connection devices are at least partly filled, while in others, they are not. In some aspects, no weighting substance is added at all. The weighting substance may include, for example, a solid or liquid substance. The material may include, for example, sand, soil, rocks, dirt, asphalt (e.g., asphalt chips), rubber, or small gravel. If a liquid substance is used, consideration may be given to small leakage, freezing and evaporation. The substance may be denser and/or heavier than a substance (e.g., fluid) that is to be contained. The substance may be poured into the openings 115. The devices 100 may then be vibrated to help settle and disperse the substance. The substance may also be pumped into the openings. In some conditions, the devices 100 can be completely filled with the substances, while in others, they are not. The amount of substance used to fill the devices 100 may be determined, for example, based on one or more of the amount of a substance (e.g., liquid) that may need to be contained, a weight or density difference or ratio between the weighting substance and the substance to be contained, the size of the perimeter, evaporation rates of the weighting substance, predicted leakage rates from the fillable devices, and the size of the fillable containers.

It should be noted that in some aspects, the fillable device (s) can be anchored or otherwise secured in place, without or in addition to the use of the weighting substance. Any suitable mechanism can be used, for example, spikes, wedges, other obstacles that prevent or minimize the ability of the devices to move or roll.

At step 935, the fill openings 115 are covered. The openings 115 may be covered by covers, structures and processes described with respect to FIGS. 2A-C.

Again, it should be noted that any of the steps discussed in connection can be removed, added to, supplemented with additional steps, reordered, etc.

Figure 10:
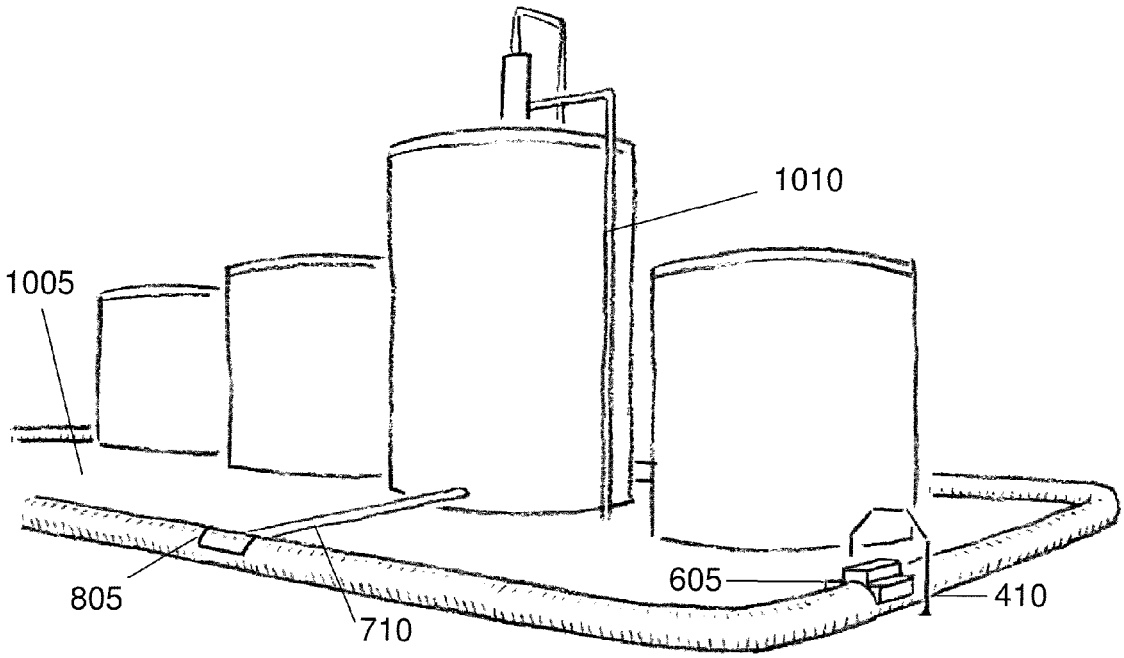
FIG. 10 shows an example of a containment region surrounded by a fillable device.

FIG. 10 shows an embodiment in which a containment region 1005 is surrounded by a plurality of devices as discussed herein. The region contains a plurality of fluid storage units 1010. The region is surrounded by various types of fillable devices 100. Borders between the devices 100 are not shown in this drawing. The step component 605 and supporting structure 410 are shown, and thus, people can easily move into and out of the region. A fluid transportation unit 710 connects to one of the fluid storage units 1010. The fluid transportation unit 710 then enters a tank connection component 805. Thus, the fluid may be accessed from the outside of the region. In some instances, a plurality of transportation units 710 and/or of the tank connection components 805 are present (e.g., for each of the fluid storage units 1010).

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

For purposes of this disclosure, certain aspects, advantages, and novel features of the embodiments are described herein. It is to be understood that not necessarily all such advantages may be achieved in accordance with any particular embodiment. Thus, for example, those skilled in the art will recognize that the embodiments may be embodied or carried out in a manner that achieves one advantage or group of advantages as taught herein without necessarily achieving other advantages as may be taught or suggested herein.

What is claimed is:

1. A containment system for containing a substance, the system comprising:

a plurality of tillable devices, each device comprising:

a first at least partly open end;

a second at least partly open end;

a cavity between the first and second open ends; and at least one opening on a top surface of the device between the first and second ends;

one or more covers configured to cover one or more of the at least one openings, wherein the tillable devices are arranged such that the first end of at least one of the devices is adjacent to the second end of another of the devices, wherein each device comprises a plurality of openings wherein at least one of the devices comprises a sleeve extending through the at least one device in a first direction, the first direction being non-parallel to a side of the device connection the first and second ends, wherein the sleeve has an exterior surface, and wherein at least part of the exterior surface of the sleeve is located inside the at least one of the devices; and a sealing component positioned inside the sleeve.

2. The containment system of claim 1, wherein the fillable devices are arranged in a closed shape, such that the first end of each of the plurality of fillable devices is adjacent to the second end of an adjacent fillable device.

3. The containment system of claim 1, wherein each device comprises a plurality of openings.

4. The containment system of claim 3, wherein the openings are between about 2 and about 6 inches in diameter.

5. The containment system of claim 1, wherein each of the one or more covers is attached to a fillable device of the plurality of devices.

6. The containment system of claim 1, wherein the fillable devices comprise one or both of high density polyethylene and a metal.

7. The containment system of claim 1, wherein the first end of at least one of the devices is facing a direction that is substantially non-parallel to a direction faced by the second end of the at least one device.

8. The containment system of claim 1, wherein at least one of the devices comprises steps.

9. The containment system of claim 1, wherein the at least one device comprises a drip catching structure below an output end of the sleeve.

10. The containment system of claim 1, wherein the substance comprises oil.

11. The containment system of claim 1, wherein the sleeve is configured to receive and subsequently surround at least part of a fluid transportation unit.

12. The containment system of claim 11, wherein the fluid transportation unit comprises a pipe.

13. The containment system of claim 1, wherein the sleeve is configured to attach to a fluid transportation unit.

14. The containment system of claim 13, wherein the fluid transportation unit comprises a pipe.

15. The containment system of claim 1, further comprising a size adapter positioned inside the sleeve.

16. The containment system of claim 1, further comprising a sealing component positioned inside the sleeve.

17. The containment system of claim 1, wherein the sealing component comprises a gasket.

18. The containment system of claim 9, wherein the drip catching structure comprises a basin.

19. A method of making a containment structure, the method comprising:

identifying a containment region;

positioning a plurality of tillable devices around at least part of the perimeter of the region; and at least partly filling the plurality of tillable devices with a weighting substance, wherein each of the plurality of tillable devices comprises:

a first at least partly open end;

a second at least partly open end;

a cavity between the first and second open ends;

at least one opening on a surface between the first and second ends, wherein at least one of the devices comprises a sleeve extending through the at least one device in a first direction, the first direction being non-parallel to a side of the device connecting the first and second ends, wherein the sleeve has an exterior surface, and wherein at least part of the exterior surface of the sleeve is located inside the at least one of the devices; and inserting a fluid transportation unit through the sleeve.

20. The method of claim 19, further comprising positioning the devices to be adjacent to each other.

21. The method of claim 19, further comprising positioning a sealing material around the perimeter.

22. The method of claim 21, wherein the sealing material comprises at least one of dirt, clay, asphalt, rubber, and bentonite.

23. The method of claim 21, wherein the weighting substance comprises at least one of sand, soil, rocks, dirt, asphalt, rubber, and gravel.

24. The method of claim 19, further comprising covering said openings with a cover.

25. The method of claim 19, wherein each device comprises a plurality of openings.

26. The method of claim 19, wherein the at least one device comprises a drip catching structure below an output end of the sleeve.

27. The method of claim 19, further comprising inserting a fluid transportation unit through the sleeve.

28. The method of claim 27, wherein the fluid transportation unit comprises a pipe.

29. The method of claim 19, further comprising connecting a fluid transportation unit to the sleeve.

30. The method of claim 29, wherein the fluid transportation unit comprises a pipe.

31. The method of claim 19, positioning a size adapter between the sleeve and the fluid transportation unit.

32. The method of claim 19, positioning a sealing component between the sleeve and the fluid transportation unit.

33. The method of claim 19, wherein the sealing component comprises a gasket.

34. The method of claim 26, wherein the drip catching structure comprises a basin.

* * * * *